US006679779B2

(12) United States Patent
Tai et al.

(10) Patent No.: US 6,679,779 B2
(45) Date of Patent: Jan. 20, 2004

(54) STRUCTURE FOR AN INFANT'S ROCKET

(75) Inventors: Chuan-Tso Tai, Chia-I Hsien (TW); Feng-Chi Chang, Chia-I Hsien (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 10/289,393

(22) Filed: Nov. 7, 2002

(65) Prior Publication Data

US 2003/0096654 A1 May 22, 2003

(30) Foreign Application Priority Data

Nov. 16, 2001 (TW) ..... 90219733 U

(51) Int. Cl.[7] ..... A63G 13/06
(52) U.S. Cl. ..... 472/95; 472/102; 297/33
(58) Field of Search ..... 472/95, 102, 135; 297/16.1, 32, 33, 258.1, 260.3, 377

(56) References Cited

U.S. PATENT DOCUMENTS 244,840 A * 7/1881 Bangs ..... 297/33
5,503,458 A 4/1996 Petrie
5,868,459 A * 2/1999 Welsh, Jr. ..... 297/32
6,251,023 B1 6/2001 Lauro et al.
6,341,816 B1 * 1/2002 Chen et al. ..... 297/16.1
6,361,106 B1 * 3/2002 Huang ..... 297/32

* cited by examiner

*Primary Examiner*—Kien T. Nguyen
(74) *Attorney, Agent, or Firm*—Birch, Stewart, Kolasch & Birch, LLP

(57) ABSTRACT

The structure is designed to allow an infant to ride, sit, or lie reclined on a rocker, and to be rocked back and forth, as well as to enable the changing of the rocker's angle of inclination, or the folding of the structure for storage. In the invention, the structure comprises a frontal support frame, a rear support frame, and an arc-shaped rocking frame. On the frontal support frame there is a movable sliding sleeve to which the rear support frame is connected by a hinge. With the movable sliding sleeve, the relative positions of the frontal support frame and the rear support frame may be changed, so as to adjust the frontal support frame's angle of inclination or to draw the frontal support frame close to the rear support frame for folding to facilitate storage.

9 Claims, 7 Drawing Sheets

STRUCTURE FOR AN INFANT'S ROCKET

This nonprovisional application claims priority under 35 U.S.C. §119(a) on Patent Application No. 090219733 filed in TAIWAN, R.O.C. on Nov. 16, 2001, which is herein incorporated by reference.

BACKGROUND OF THE INVENTION

1. Field of Invention

The invention relates to a structure for an infant's rocker, allowing an infant to ride, sit, or lie reclined on the rocker, and to be rocked back and forth. The invention is aimed at infant's rockers that rock back and forth on the floor, and more particularly, to a structure for an infant's rocker that can vary the angle of inclination at which the infant lies, and can be folded up for storage.

2. Related Art

The disclosed infant's rocker is designed to provide an infant with the ability to ride, sit, or lie reclined on a rocker, and to be rocked back and forth. At the same time, the invention achieves the objective of enabling a carrying apparatus or a recliner to have various implementation configurations. For example, U.S. Pat. No. 6,251,023 discloses a structure for a hanging infant's rocker, which is a type of rocker whose structure is mostly comprised of a support frame, swinging arms, and a seat, where the support frame stands on the floor, the two swinging arms are connected by hinges to the support frame, and the seat is installed on the two swinging arms, so that the seat can swing back and forth in an arced motion through the two swinging arms. This kind of structure for a hanging type of infant's rocker is usually quite bulky, and takes up a lot of space.

Also, U.S. Pat. No. 5,503,458 discloses an elastic structure for an infant's rocker that comprises a chassis and an elastic frame. The elastic frame is connected to an end of the chassis forming an included angle. The chassis sits on the floor, and the elastic frame can be set in motion in a vertical direction to a small extent due to the included angle between the elastic frame and the chassis. Thus, the elastic frame may bounce upward and downward.

In addition, there is an arc-shaped structure for an infant's rocker, which has the simplest structure. It comprises an arc-shaped chassis on which an infant's holder is found, and a back and forth rocking motion is achieved through the arc shape of the chassis that is always in contact with the floor. The infant's holder installed on this type of arc-shaped infant's rocker may be composed of a plurality of tubes, most of which cannot be folded up, and cannot change the angle of inclination for the infant lying in it when needed, thus constituting an insufficiency in design for the users.

SUMMARY OF THE INVENTION

The primary objective of the invention is to provide a structure for an infant's rocker (hereinafter referred to as "the structure") that can change the angle of inclination for the infant lying in it.

The structure disclosed by the invention comprises an arc-shaped rocking frame, a frontal support frame, a sliding sleeve and a rear support frame. The arc-shaped rocking frame sits on the floor, and it rocks back and forth because of its arc-shaped outline. The frontal support frame and the rear support frame are connected through hinges to the two ends of the arc-shaped rocking frame respectively. The sliding sleeve is connected to the frontal support frame, though it may be slid along the frontal support frame. The other end of the rear support frame is connected through hinges to the sliding sleeve. The relative positions of the frontal support frame and the rear support frame can be varied by changing the position of the sliding sleeve on the frontal support frame. As a result, an infant may ride, sit, or lie reclined on the rocker with different angles of inclination when adjustments are made to the angle of the frontal support frame. Or, the frontal support frame and the rear support frame can be adjusted to be closer to each other, so that the structure takes up less space, which is beneficial for storage. There is also a lock on the sliding sleeve, which enables the position of the sliding sleeve to be changed freely from the frontal support frame, or fixed at its adjusted position.

To make the aforesaid or any other objective, characteristic and merit of the invention more clear and easier to understand, a preferred embodiment, with drawings attached, is given below to illustrate the invention in detail.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

The structure for an infant's rocker disclosed by the invention relates to an arc-shaped rocking frame that allows the rocker to be rocked.

Figure 1:
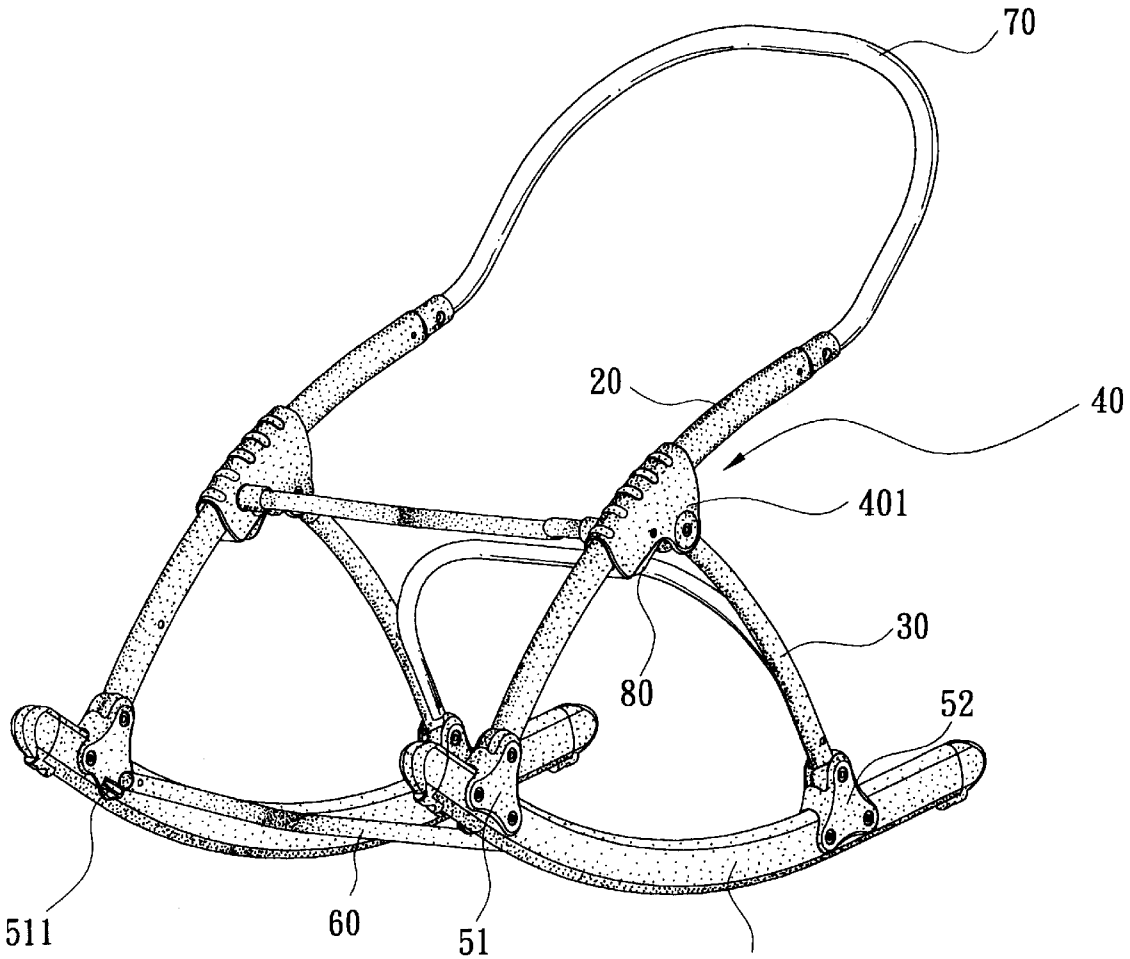
FIG. 1 is a 3-D diagram showing the components of the invention.
Figure 2A:
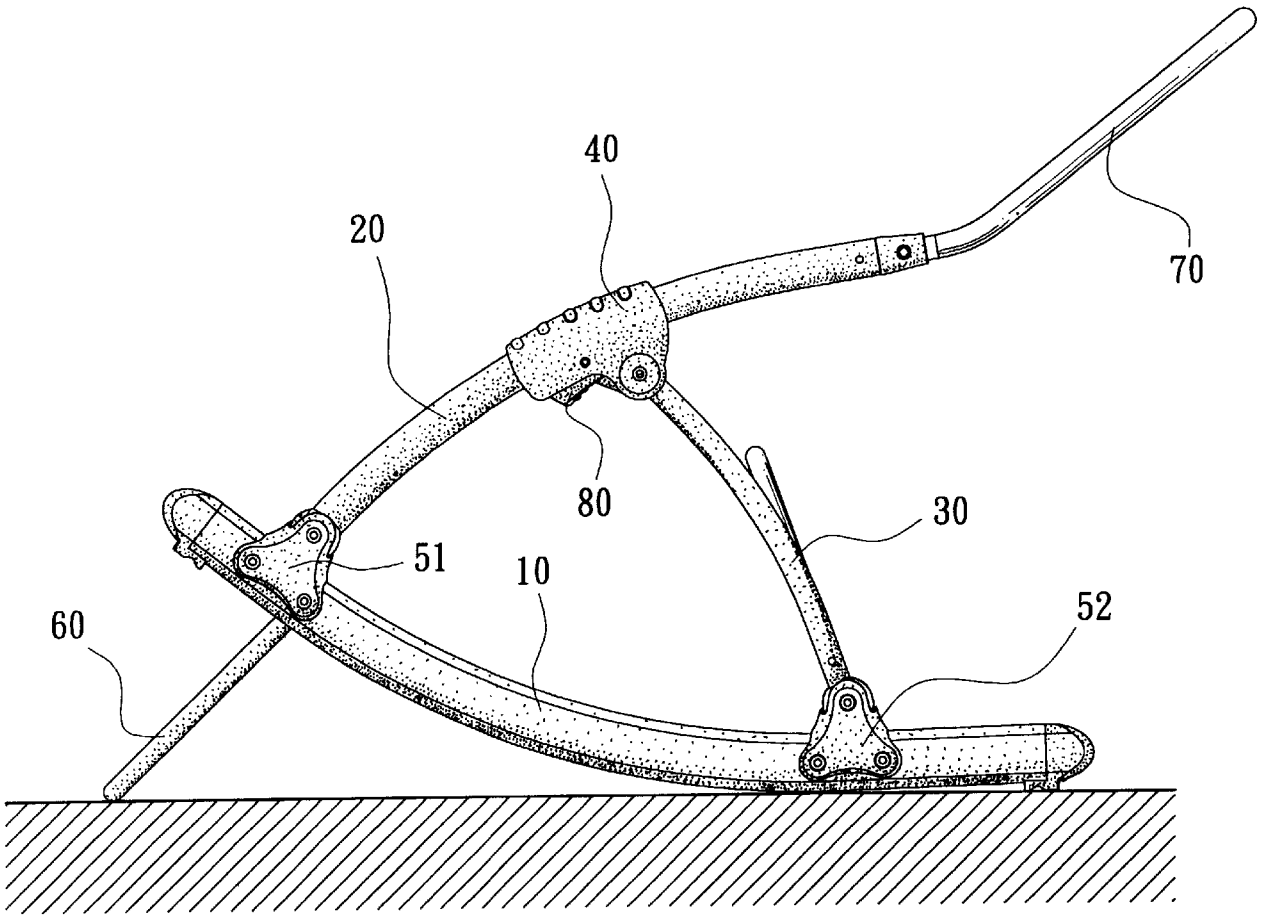
FIGS. 2A & 2B are the plans showing the components of the invention.

As shown in FIGS. 1 & 2A, the structure for an infant's rocker disclosed by the invention mainly comprises an arc-shaped rocking frame 10, a frontal support frame 20, a rear support frame 30 and a sliding sleeve 40.

The arc-shaped rocking frame 10 is a tube with its two ends bending upward. The arc-shaped rocking frame 10 sits on the floor with its central portion in touch with the floor and its two ends bending upward. There is a frontal hinged connection region 51 and a rear hinged connection region 52 at the two ends of the arc-shaped rocking frame 10 respectively. On the inner side of the frontal hinged connection region 51 is a stoppage peg 511. A stoppage rod 60 is connected by hinges to the arc-shaped rocking frame 10 near the stoppage peg 511. Although the stoppage rod 60 is connected to the arc-shaped rocking frame 10, it can be moved along the arc-shaped rocking frame 10, and has at least one storage position close to the arc-shaped rocking frame 10, as well as at least one stoppage position extending away from the arc-shaped rocking frame 10. When the stoppage rod 60 is in storage position, (it may be fixed by a fastener, not shown in the figures) the arc-shaped rocking frame 10 may be rocked freely. When the stoppage rod 60 is in stoppage position, it is pointing right at the stoppage peg 511, so that it is fixed at the stoppage position and it sticks out against the floor and thus prevents the arc-shaped rocking frame 10 from rocking.

The frontal support frame 20 is a tube, with one of its end connected by hinges to the frontal hinged connection region 51, while its other end is equipped with an armrest 70. The frontal support frame 20 may swing with the hinged connection region 51 as the axis of the swinging movement. There is a plurality of positioning regions 201 aligned on the frontal support frame 20. The positioning regions 201 are the holes found on the wall of the tube of the frontal support frame 10. The frontal support frame 10 may be covered with a piece of knitted cloth (not shown in the figures). The piece of knitted cloth forms the seat for an infant or an infant to lie, ride or sit on.

Figure 3B:
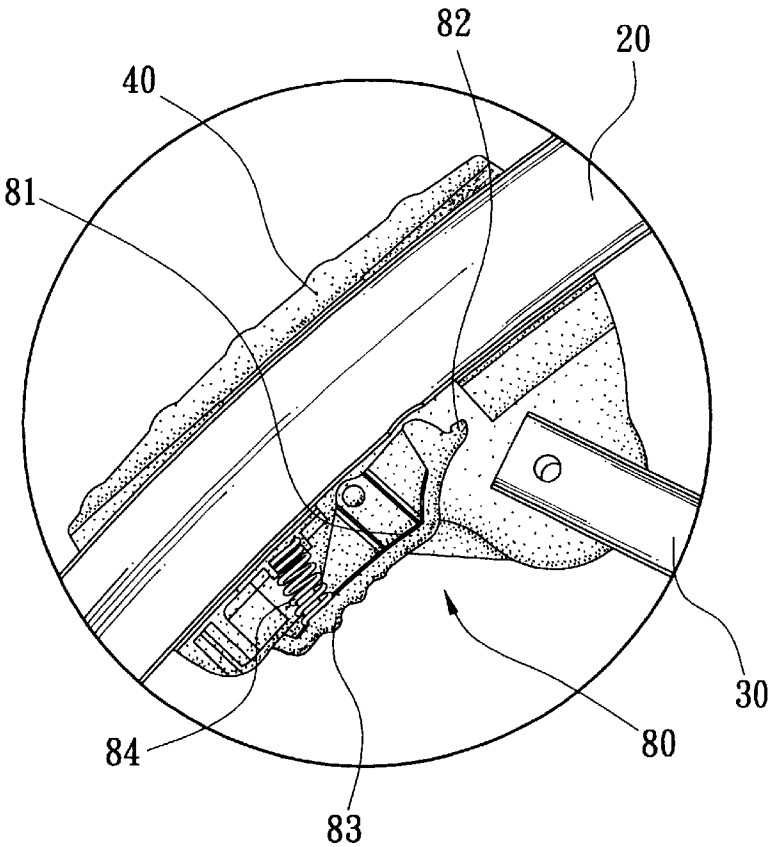
FIGS. 3A & 3B show part of the components of the invention.
Figure 3A:
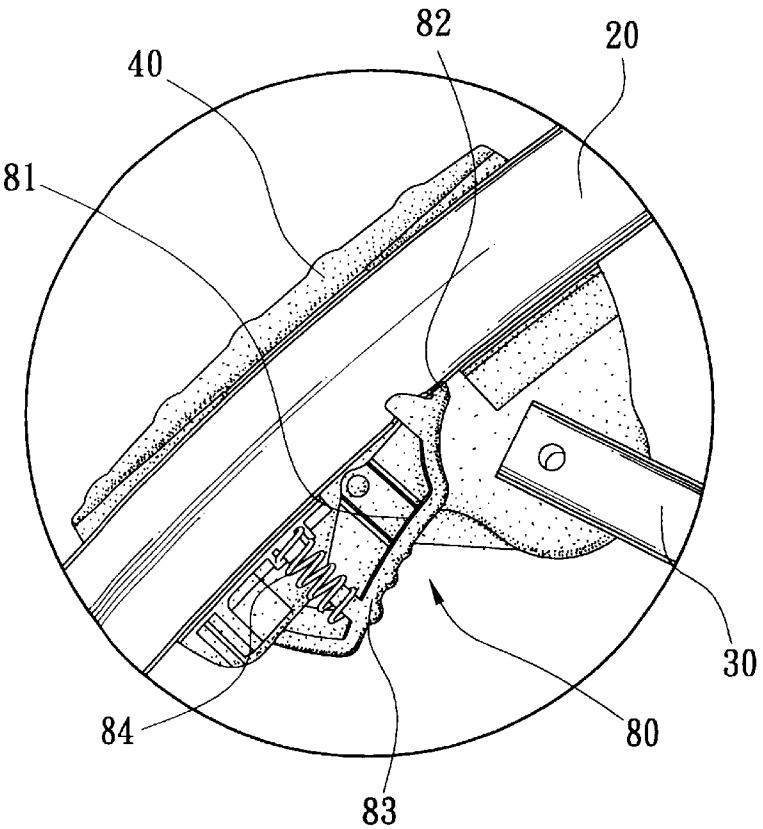

The sliding sleeve 40 may be slid along the frontal support frame 20. There is a hinged connection region 401 on the sliding sleeve 40. There is a lock 80 on the positioning region 201, which corresponds to the frontal support frame 20 of the sliding sleeve 40. As shown in FIGS. 3A & 3B, the lock 80 comprises a controller 81. The central part of the controller 81 is connected by hinges to the sliding sleeve 40, so that the controller 81 may swing sideways with the connection portion as the axis of the swinging movement. On one end of the controller 81 is a fastening lock 82. On the other end is the press region 83. Underneath the press region 83 is an elastic element 84. Normally, with the elastic element 84, the fastening lock 82 is inserted into a positioning region 201 of the frontal support frame 20. As a result, the lock 80 is in a locking position and thus the sliding sleeve 40 is fixed on the frontal support frame 20. If the press region 83 is pressed, the fastening lock 82 is detached from the positioning region 201 so that the lock 80 is in a released position and the sliding sleeve 40 can slide freely along the frontal support frame 20.

The rear support frame 30 is a tube. One of its ends is connected by hinges to the rear hinged connection region 52, while the other end is connected by hinges to a hinge connection region 401 on the sliding sleeve 40. While the sliding sleeve 40 is sliding along the frontal support frame 20, it causes the rear support frame 30 to move, so that the relative positions of the frontal support frame 20 and the rear support frame 30 will vary.

Figure 4A:
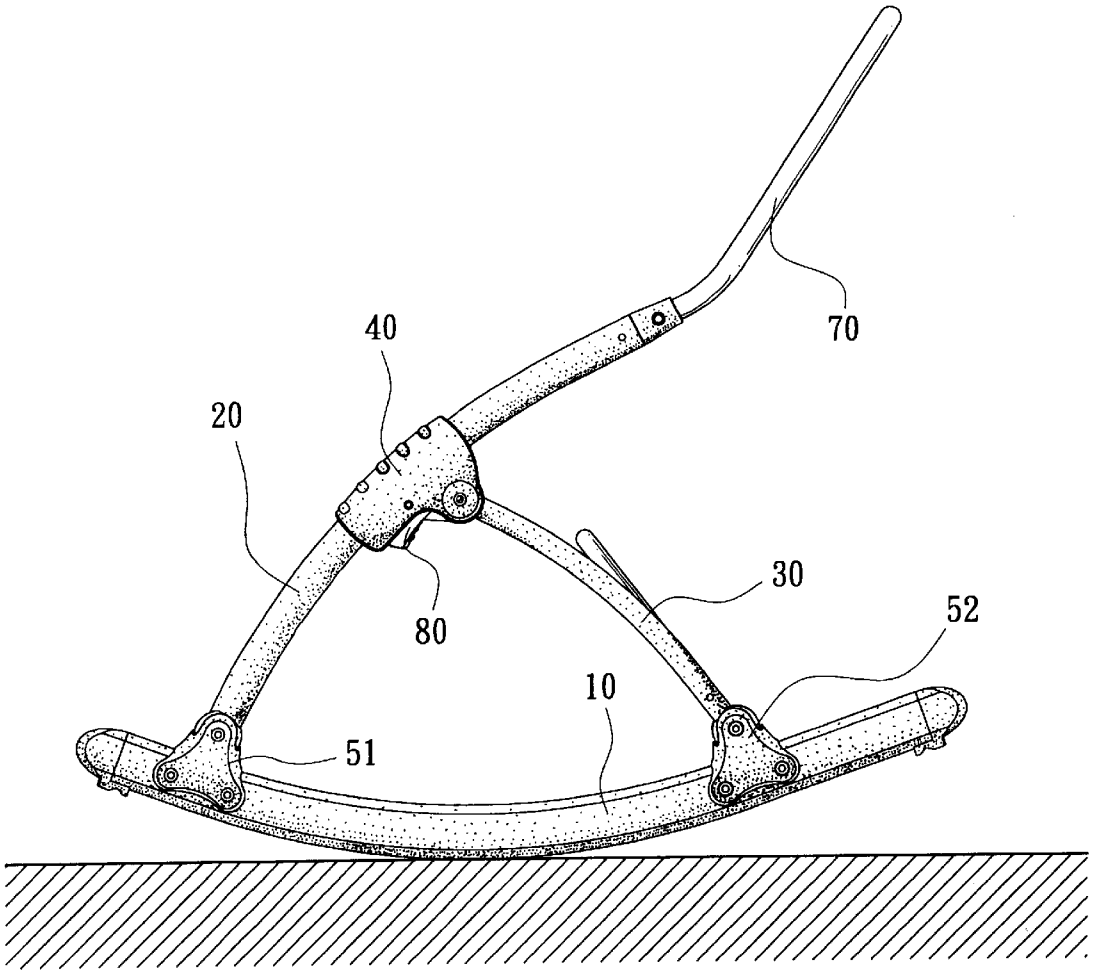
FIG. 4A is a diagram showing the condition of the invention.
Figure 4B:
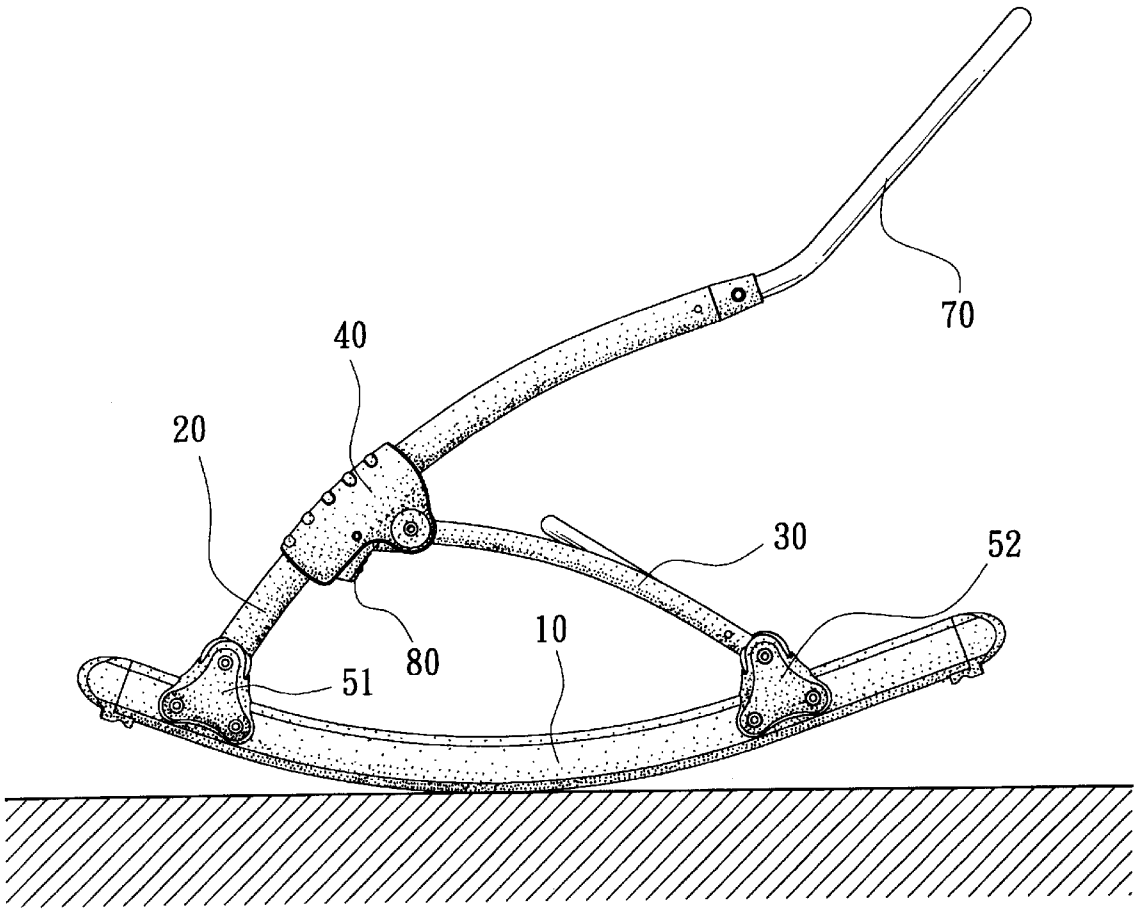
FIG. 4B is another diagram showing the condition of the invention.
Figure 4C:
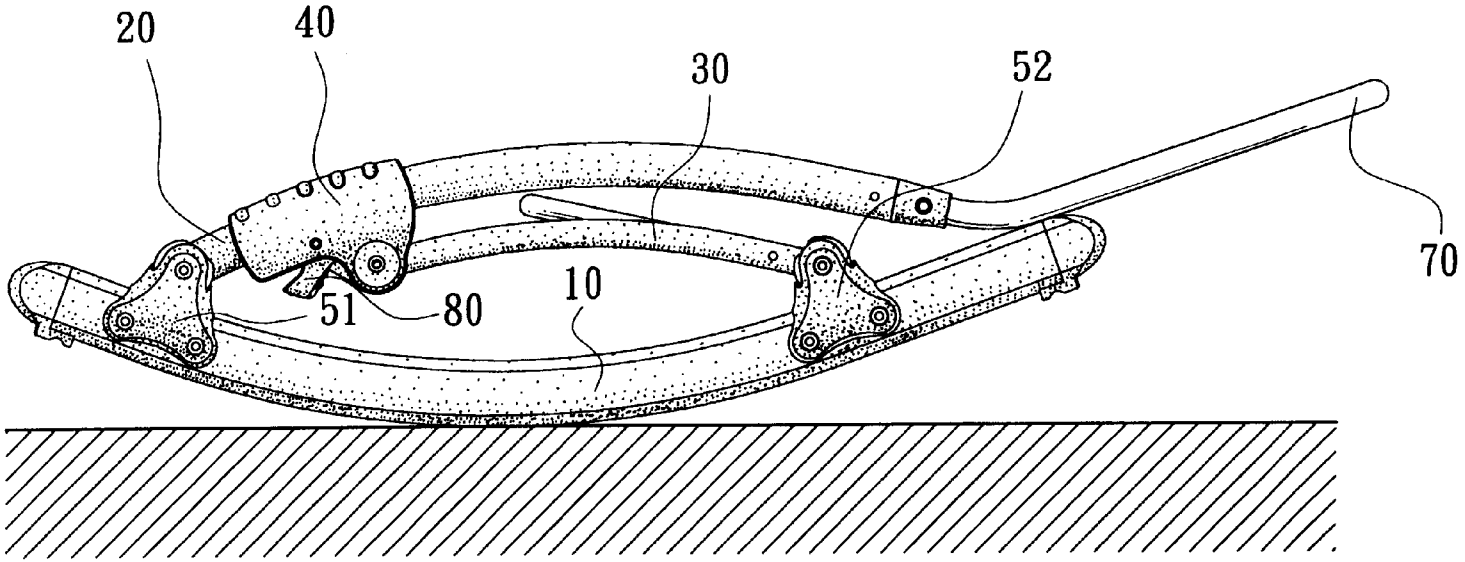
FIG. 4C is a third diagram showing the condition of the invention.

As shown in FIG. 4A, according to the structure for an infant's rocker disclosed by the invention, the sliding sleeve 40 is fixed in a positioning region 201 of the frontal support frame 20 through the lock 80. The frontal support frame 20 and the rear support frame 30 support each other. An infant may lie on a piece of knitted cloth that covers the frontal support frame 20 (not shown in the figure), and rock by means of the arc-shaped rocking frame 10. Sometimes the angle of inclination of an infant who is riding or sitting in the rocker determines how comfortable the ride or the seat is. The invention is designed to adjust this angle of inclination. As shown in FIG. 4B, in the event that a change is to be made in the angle of inclination of the frontal support frame 20, pressing the press region 83 of the lock 80 to move the fastening lock 82 to the released position slides the sliding sleeve 40 onto the next positioning region 201. Then, release the press region 83 so as to make the fastening lock 82 go back to the locking position of the positioning region 201. As a result, the relative positions of the rear support frame 30 and the frontal support frame 20 are varied, making an adjustment in the angle of inclination of the frontal support frame 20, so that an infant can lie on the holder of the rocker with different angles of inclination. The plurality of positioning regions 201 found on the frontal support frame 20 allow for a number of inclination angles of the frontal support frame 20 by means of the aforesaid adjustment. As shown in FIG. 4C, in the event that a user is not using the structure, the user may move the sliding sleeve 40 to the lowest positioning region 201 to bring the frontal support frame 20 and the rear support frame 30 together, so that the structure takes up less space and thus is easier to store.

Figure 2B:
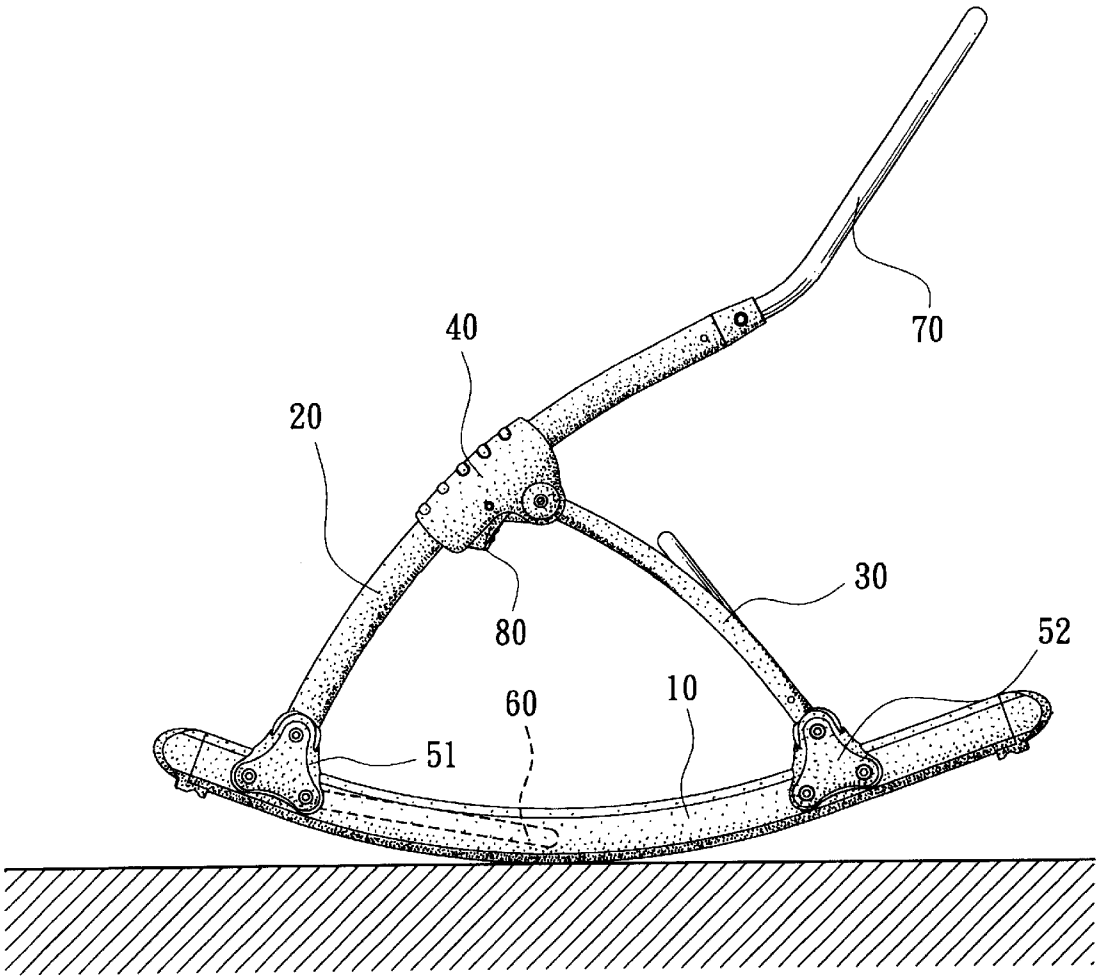

As shown in FIGS. 2A & 2B, the infant's rocker disclosed by the invention may be prevented from rocking by sticking out a stoppage rod 60 against the floor. Therefore, by varying the angle of inclination of the frontal support frame 20, a seat with different angles of inclination is available for use—a variation in the use of the invention.

As disclosed by the invention, a structure for an infant's rocker is not only designed for an infant to lie, ride or sit on, but it also enable alteration of the angle of inclination of the frontal support frame, allowing the infant to ride or sit on the rocker in different ways. In addition, the frontal support frame and the rear support frame of the structure may be brought together, so that the structure takes up less space and thus is easier to store.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A structure for an infant's rocker comprising:

an arc-shaped rocking frame lying on the floor for rocking purpose;

a frontal support frame connected through hinges to the front end of the arc-shaped rocking frame, and on the frontal support frame there are a plurality of positioning regions;

a sliding sleeve movable connected to the frontal support frame having a lock for defining a locking position and a released position, when the lock is in the locking position, the lock will be locked in the positioning region and thus the sliding sleeve will be fixed on the frontal support frame, and when the lock is in the released position, the lock will be freed from the positioning region and thus the sliding sleeve can be moved along the frontal support frame; and a rear support frame with two ends, one of the ends connected through hinges to the rear end of the arc-shaped rocking frame, and the other end connected through hinges to the sliding sleeve;

wherein the sliding sleeve moves the rear support frame so that the position of the rear support frame can be varied relative to the frontal support frame, as a result, not only can adjustments be made in the angle of inclination of the frontal support frame, but also can the frontal support frame and the rear support frame be brought together for easy storage.

2. The structure for an infant's rocker of claim 1, wherein the arc-shaped rocking frame also comprises stoppage rod having a storage position close to the arc-shaped rocking frame as well as a stoppage position whereby the stoppage rod sticks out against the floor and thus prevents the arc-shaped rocking frame from rocking.

3. The structure for an infant's rocker of claim 1, wherein the arc-shaped rocking frame comprises of a frontal hinged connection region providing hinged connection for the frontal region and a rear hinged connection region providing hinged connection for the rear support and being separated by a distance.

4. The structure for an infant's rocker of claim 3, wherein on the inner side the frontal hinged connection region is a stoppage peg that allows the stoppage rod to be fixed in the stoppage position.

5. The structure for an infant's rocker of claim 1, wherein the upper end of the frontal support frame is equipped with an armrest.

6. The structure for charging an electric vehicle of claim 1, wherein the frontal support frame is covered with a soft piece of knitted cloth for an infant to ride or sit on.

7. The structure for an infant's rocker of claim 1, wherein the positioning regions are the holes found on the wall of the frontal support frame.

8. The structure for an infant's rocker of claim 1, wherein the sliding sleeves comprises of a hinged connection region for the hinged connection for the rear support frame.

9. The structure for an infant's rocker of claim 1, wherein the lock comprises of a controller; the central part of the controller is connected through hinges to the sliding sleeve; on the one end of the controller is a fastening lock, while on the other end is a press region; underneath the press region is an elastic element; normally, with the elastic element, the fastening lock is inserted into the locking position of the positioning region; in the event that the press region is pressed with a force, the fastening lock will be moved to the released position.

* * * * *

UNITED STATES PATENT AND TRADEMARK OFFICE

CERTIFICATE OF CORRECTION

PATENT NO. : 6,679,779 B2
DATED : January 20, 2004
INVENTOR(S) : Tai et al.

It is certified that error appears in the above-identified patent and that said Letters Patent is hereby corrected as shown below:

Title page,
Item [54], Title, should read -- STRUCTURE FOR AN INFANT'S ROCKER --

Signed and Sealed this

Twenty-ninth Day of March, 2005

JON W. DUDAS
*Director of the United States Patent and Trademark Office*